US007614163B2

(12) United States Patent
Fujii

(10) Patent No.: US 7,614,163 B2
(45) Date of Patent: Nov. 10, 2009

(54) SHOCK-ABSORBING ELASTIC SHEET FOR SHOES, CUSHION PAD FORMED FROM THE ELASTIC SHEET, AND SHOE HAVING SUCH CUSHION PAD

(76) Inventor: Takao Fujii, 20-11, Takamatsu 4-chome, Nerima-ku, Tokyo (JP)

( * ) Notice: Subject to any disclaimer, the term of this patent is extended or adjusted under 35 U.S.C. 154(b) by 565 days.

(21) Appl. No.: 11/423,601

(22) Filed: Jun. 12, 2006

(65) Prior Publication Data

US 2006/0277788 A1 Dec. 14, 2006

(30) Foreign Application Priority Data

Jun. 13, 2005 (JP) ..... 2005-171898

(51) Int. Cl.
*A43B 13/38* (2006.01)
*A43C 20/02* (2006.01)

(52) U.S. Cl. ..... 36/43; 36/28; 36/3 B; 5/655.3

(58) Field of Classification Search ..... 36/43, 36/28, 3 B, 44, 29, 35 B, 35 R, 71; 5/655.3, 5/710; 428/131, 180, 156
See application file for complete search history.

(56) References Cited

U.S. PATENT DOCUMENTS 55,247 A * 6/1866 Daggett ..... 36/3 B
655,576 A * 8/1900 Pearson ..... 36/3 R
989,894 A * 4/1911 Byrne ..... 36/153
2,030,545 A * 2/1936 Schulze ..... 36/3 B
4,345,387 A * 8/1982 Daswick ..... 36/43
4,779,359 A * 10/1988 Famolare, Jr. ..... 36/29
5,655,314 A * 8/1997 Petracci ..... 36/3 B
6,857,202 B2 * 2/2005 Pfander ..... 36/3 R

FOREIGN PATENT DOCUMENTS

JP 2000-316606 11/2000

* cited by examiner

*Primary Examiner*—Ted Kavanaugh
(74) *Attorney, Agent, or Firm*—Rankin, Hill & Clark LLP

(57) ABSTRACT

A shock-absorbing elastic sheet comprises a single sheet of elastic material having a flat sheet-like base portion and a large number of semispherical protrusions integral with and projecting from one surface of the flat base portion. The semispherical protrusions are arranged in direct contact with one another such that every adjacent three or more of the semispherical protrusions jointly define a valley therebetween. The sheet-like base portion has a large number of breathing holes formed therein, each of the breathing holes being located at a position corresponding to the position of one of the respective valleys. A cushion pad produced from the elastic sheet, a sole insert and a shoe in which the cushion pad is incorporated are also disclosed.

25 Claims, 5 Drawing Sheets

SHOCK-ABSORBING ELASTIC SHEET FOR SHOES, CUSHION PAD FORMED FROM THE ELASTIC SHEET, AND SHOE HAVING SUCH CUSHION PAD

FIELD OF THE INVENTION

The present invention relates to a shock-absorbing elastic sheet for use in the production of cushion pads adapted to be incorporated in a sole insert of a shoe or attached directly to an inner sole member of a shoe so as to provide the shoe with a shock-absorbing function and a breathing function. The invention also relates to a cushion pad produced from the elastic sheet, a sole insert and a shoe in which such cushion pad is incorporated.

BACKGROUND OF THE INVENTION

Shoes having a shock-absorbing function and a breathing function are known as disclosed, for example, in Japanese Patent (JP-B1) No. 3011408.

The disclosed shoe has a sole member formed with a recessed portion opening toward an internal space of the shoe, and an elastic member fitted in the recessed portion. The elastic member has shock-absorbing ability and breathability. More specifically, the elastic member comprises an elastic case having a plurality of airflow holes or orifices formed therein, and a large number of elastic particles packed in layers within the case. The recessed portion is formed in a ball portion and a heel portion of the sole member, which respectively correspond in position to a ball and a heel of the wearer's foot. The elastic particles are formed from spheres or balls of elastic rubber. In one preferred embodiment, the rubber balls have a diameter of 5 mm and a hardness of Hs 40.

By virtue of the elastic members placed in the ball and heel portions of the sole member with the elastic balls packed in layers therein, the shoe can offer a good shock-absorbing capability in which the elastic balls absorb shocks during walking. At the same time, by virtue of the airflow orifices formed in each elastic case filled with the elastic balls, the shoe can also offer a breathing capability in which a promoted breathing action (or airflow inside the shoe) takes place upon repeated compression and recovery of the shape of individual elastic balls.

However, due to the elastic members embedded in the ball and heel portions of the sole member, the conventional shoe requires a considerably large amount of elastic balls for forming such elastic members. Furthermore, since the elastic balls are packed in layers, functionality-focused designing of the shoes will render the elastic members large in thickness. The thick elastic members are disadvantageous particularly when they are incorporated in a sole insert because the sole insert itself becomes thick and hence is less fashionable and defective from an aesthetic viewpoint. Additionally, since the elastic balls packed in layers within the elastic case can flow or move either within the same ball layer or between adjacent ball layers during use, foot comfort of the conventional shoe is not fully satisfactory.

Due to the difficulties discussed above, the conventional shoe is not suitable for applications where a sole insert is not used or the fashionability or aesthetic appearance is a major requirement such as experienced in the case of women's shoes including pumps, mules, sandals or the like.

Shoes having a shock-absorbing function have found an increasing demand regardless of whether the shoes are used for athletic or walking purposes, or for business purposes. Even in the case of women's shoes, such as pumps, mules or sandals, which are generally used without a sole insert, the shock-absorbing function is desirable to the extent that the fashionability or aesthetic appearance of the shoes is not deteriorated.

SUMMARY OF THE INVENTION

It is, therefore, an object of the present invention to provide a shock-absorbing elastic sheet for use in the production of cushion pads adapted to be incorporated in a sole insert of a shoe or attached directly to an inner sole of the shoe so as to provide the shoe with a shock-absorbing function and a breathing function.

Another object of the invention is to provide a cushion pad produced from the shock-absorbing elastic sheet, and a sole insert and a shoe in which the cushion pad is incorporated.

According to a first aspect of the present invention, there is provided a shock-absorbing elastic sheet, comprising a single sheet of elastic material having a flat sheet-like base portion and a large number of semispherical protrusions integral with and projecting from one surface of the sheet-like base portion. The semispherical protrusions are arranged in direct contact with one another such that every adjacent three or more of the semispherical protrusions jointly define a valley therebetween. The sheet-like base portion has a large number of breathing holes formed therein, each of the breathing holes being located at a position corresponding to the position of one of the respective valleys.

By virtue of the elasticity of the material forming the elastic sheet, the elastic sheet is able to perform a shock-absorbing function when subjected to a force or pressure acting at an angle to the general plane of the elastic sheet. Furthermore, owing to the breathing holes, the elastic sheet is also able to perform a breathing function when it is compressed and then allowed to restore its original shape. The elastic sheet can be produced by molding and hence is relatively inexpensive to manufacture.

The elastic material of the shock-absorbing elastic sheet preferably comprises silicone rubber. In one preferred form of the invention, the sheet-like base portion has a thickness of 0.5 to 1.0 mm, the semispherical protrusions have a diameter of 5.0 mm and a height of 1.5 to 2.5 mm, and the breathing holes have an inside diameter of 1.0 mm.

The present invention in a second aspect provides a cushion pad of a desired configuration cut out from the shock-absorbing elastic sheet. The cushion pad thus provided necessarily comprises a sheet-like base portion and a number of semispherical protrusions integral with and projecting from one surface of the sheet-like base portion, the semispherical protrusions being arranged in direct contact with one another such that every adjacent three or more of the semispherical protrusions jointly define a valley therebetween. The sheet-like base portion and the semispherical protrusions are integrally formed from an elastic material, and the sheet-like base portion has a number of breathing holes formed therein, each of the breathing holes being located at a position corresponding to the position of one of the respective valleys. The cushion pad is able to perform a shock-absorbing function when the semispherical protrusions are compressed and also perform a breathing function when the semispherical protrusions are compressed and subsequently allowed to restore their original shape. The cushion pad can be readily produced by, for example, cutting the shock-absorbing elastic sheet into a desired configuration and hence is relatively inexpensive to manufacture.

According to a third aspect of the present invention, there is provided a sole insert for a shoe, comprising a sole insert body for removable insertion in the shoe and having at least one recess formed therein, and at least one cushion pad formed from an elastic material and fitted in the at least one recess of the sole insert body. The cushion pad is structurally and functionally the same as the one described above. The sole insert body has a ball portion and a heel portion respectively corresponding in position to a ball and a heel of a shoe wearer's foot, and the at least one recess preferably comprises two recesses located at the ball portion and the heel portion of the sole insert body for a purpose described later. Preferably, the at least one cushion pad comprises a plurality of cushion pads disposed in a stacked fashion within the recess. The cushion pads may be disposed with the protrusions directed toward an open end of the recess. The number of the cushion pad is optional and can be determined depending on cushioning performance required for the sole insert. The sole insert body is preferably formed from urethane.

The invention in a fourth aspect provides a shoe comprising a shoe body having an internal space for receiving herein a wearer's foot and a fixed sole member defining part of the internal space, and a sole insert having a body removably inserted in the internal space of the shoe body and laid over the fixed sole member of the shoe body. The sole insert is structurally and functionally the same as the sole insert discussed above. The sole insert may be placed in the shoe such that an open end of each recessed portion is closed by the fixed sole member of the shoe body. As is well known, the weight of a wearer during walking acts intensively on the ball and heel portions of the sole insert body. Since the cushion pads are provided at the ball and heel portions of the sole insert body, they can effectively absorb shocks through elastic deformation of the semispherical protrusions of the cushion pads occurring when the wearer lands on the foot. During walking, the semispherical protrusions are repeatedly compressed and allowed to restore their original shape with the result that air is expelled from and taken into the recessed portions through the breathing holes of the cushion pads. With this breathing action, air inside the shoe is circulated so that the shoe inside is prevented from becoming hot and humid. Thus, the shoe can offer a high level of foot comfort to the shoe wearer.

According to a fifth aspect of the invention, there is provided a shoe comprising a shoe body having a fixed inner sole member for supporting thereon a wearer's foot, and a cushion pad attached to the inner sole member of the shoe body. The cushion pad is structurally and functionally the same as the cushion pad described above. In case where the shoe is a women's shoe such as a pump, mule or sandal, it is preferable that only one cushion pad is directly attached to a ball portion and/or heel portion of the sole member. Such a single cushion pad is thin and does not deteriorate the aesthetic appearance of the shoe.

BRIEF DESCRIPTION OF THE DRAWINGS

Certain preferred structural embodiments of the present invention will be described in detail herein below, by way of example only, with the reference to the accompanying drawings, in which.

DETAILED DESCRIPTION OF THE PREFERRED EMBODIMENTS

Figure 1:
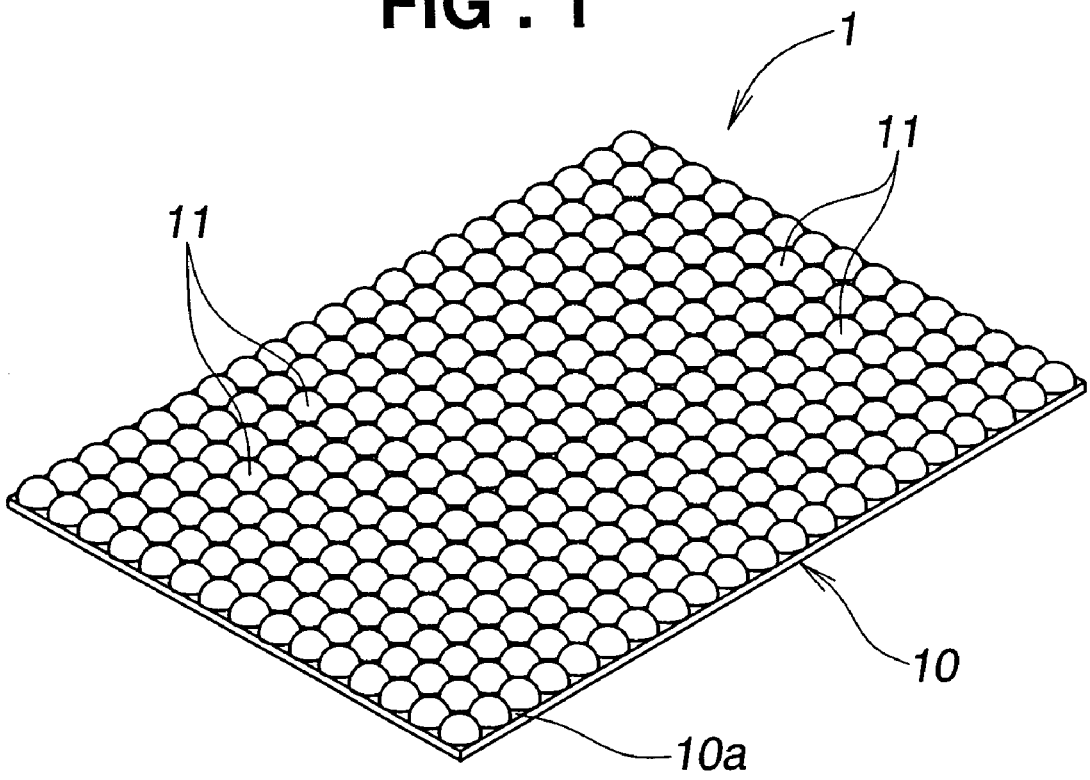
FIG. 1 is a perspective view showing a front side of a shock-absorbing elastic sheet according to an embodiment of the present invention.
Figure 2:
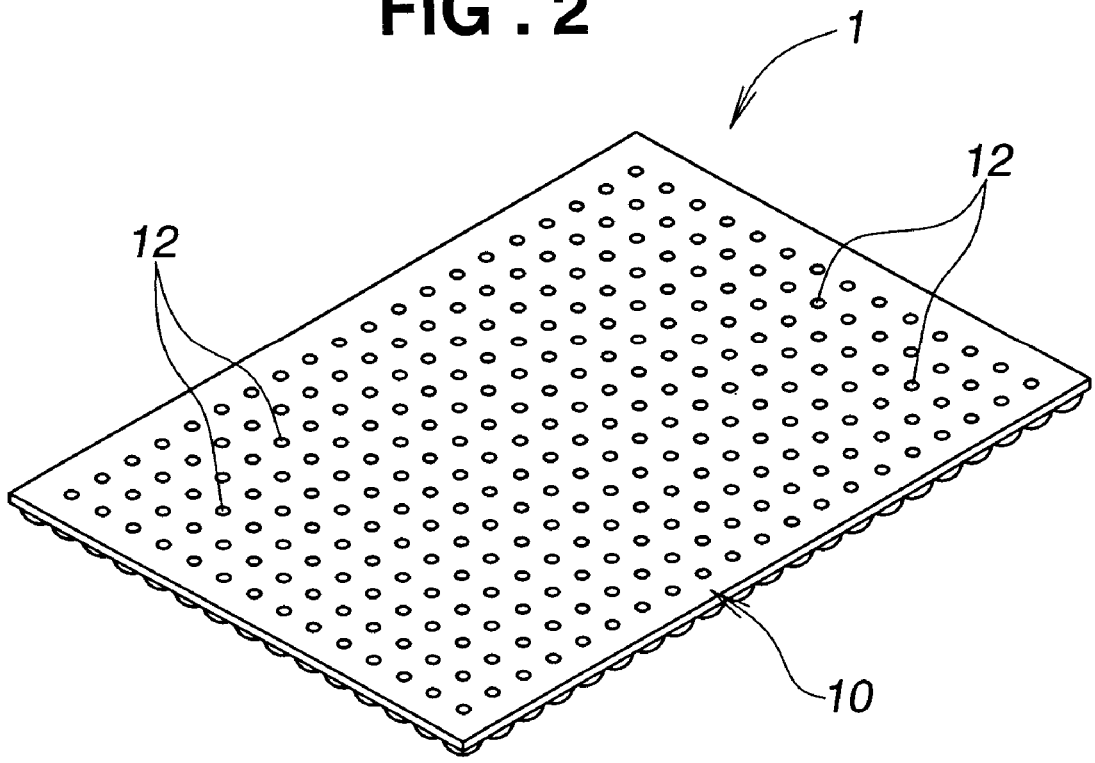
FIG. 2 is a view similar to FIG. 1, but showing a rear side of the shock-absorbing elastic sheet.
Figure 3:
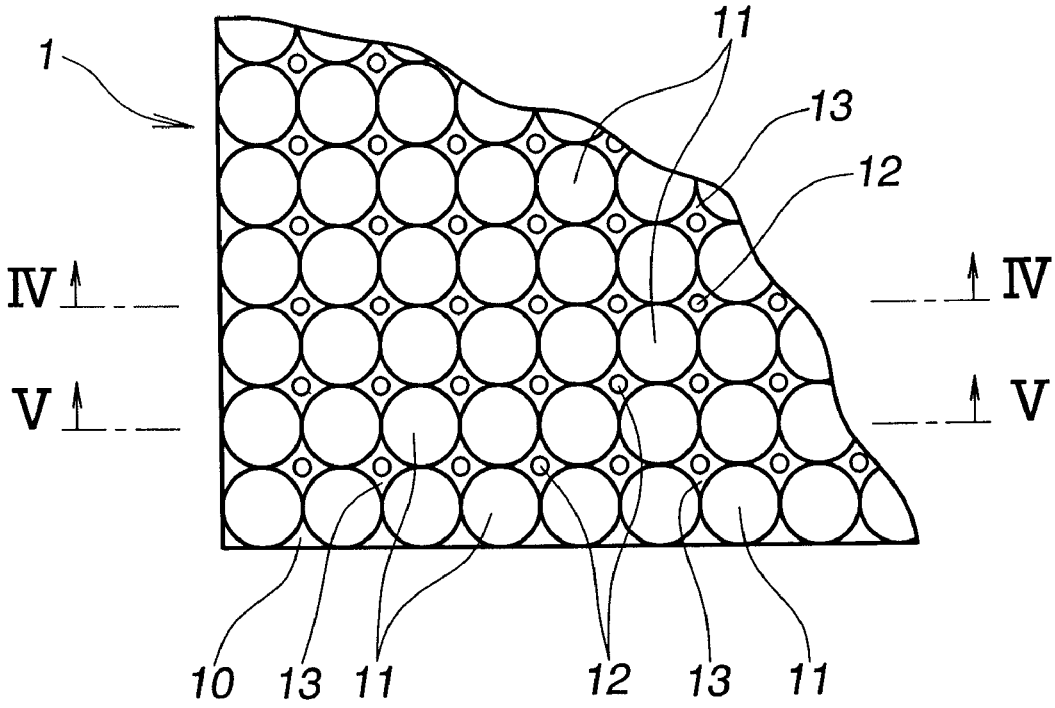
FIG. 3 is a fragmentary plan view showing, on enlarged scale, a part of the shock-absorbing elastic sheet.
Figure 4:
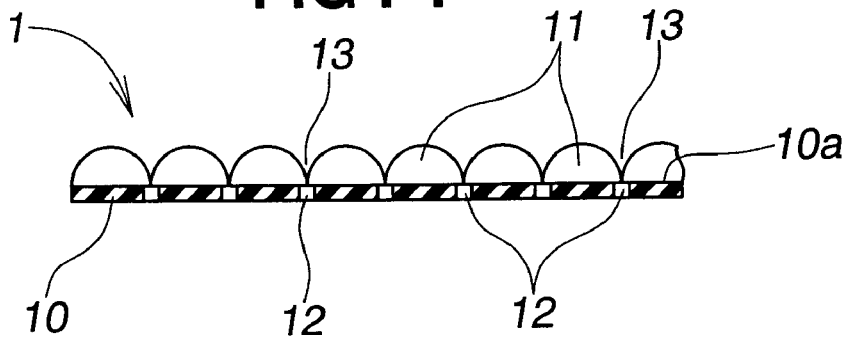
FIG. 4 is a cross-sectional view taken along line IV-IV of FIG. 3.
Figure 5:
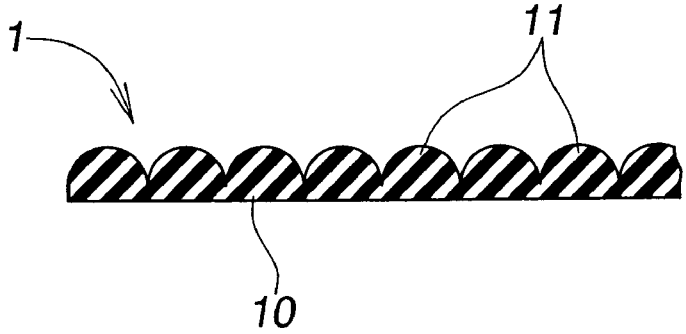
FIG. 5 is a cross-sectional view taken along line V-V of FIG. 3.

Referring now to the drawings and FIG. 1 in particular, there is shown a shock-absorbing elastic sheet 1 according to an embodiment of the present invention. The sheet 1 comprises a single sheet of elastic material, such as silicone rubber, having a shock-absorbing property. The shock-absorbing elastic sheet 1 includes a flat sheet-like base portion 10 and a large number of semispherical protrusions 11 integral with and projecting from one surface (front surface) 10*a* of the flat base portion 10. As shown in FIG. 3, the semispherical protrusions 11 are arranged without clearance or in direct contact with one another such that every adjacent four semispherical protrusions 11 jointly define therebetween a single recessed portion or valley 13. The base portion 10 has a large number of breathing holes 12 (FIGS. 2, 3 and 4) formed therein. Each of the breathing holes 12 is located at a position corresponding to the position of one of the respective valleys 13. In the embodiment shown in FIGS. 1-5, the semispherical protrusions 11 are arranged in a matrix pattern having vertical columns and horizontal rows. The shock-absorbing elastic sheet 1 can be produced by molding and hence is inexpensive to manufacture.

By virtue of the elasticity of the material (silicone rubber) forming the elastic sheet 1 and more particularly the semispherical protrusions 11 thereof, the elastic sheet 1 is able to perform a shock-absorbing function when subjected a compressive force or pressure acting at an angle to the plane of the elastic sheet 1. Furthermore, due to the presence of the breathing holes 12, the elastic sheet 1 can perform a breathing function when it is compressed and allowed to restore its original shape.

In one preferred form of the invention, the flat sheet-like base portion 10 has a thickness of 0.5 to 1.0 mm, the semispherical protrusions 11 have a diameter of 5.0 mm and a height of 1.5 to 2.5 mm, and the breathing holes 12 have an inside diameter of 1.0 mm. Thus, the shock-absorbing elastic sheet 1 formed from silicone rubber has a total thickness of 2.0 to 3.5 mm.

Figure 6:
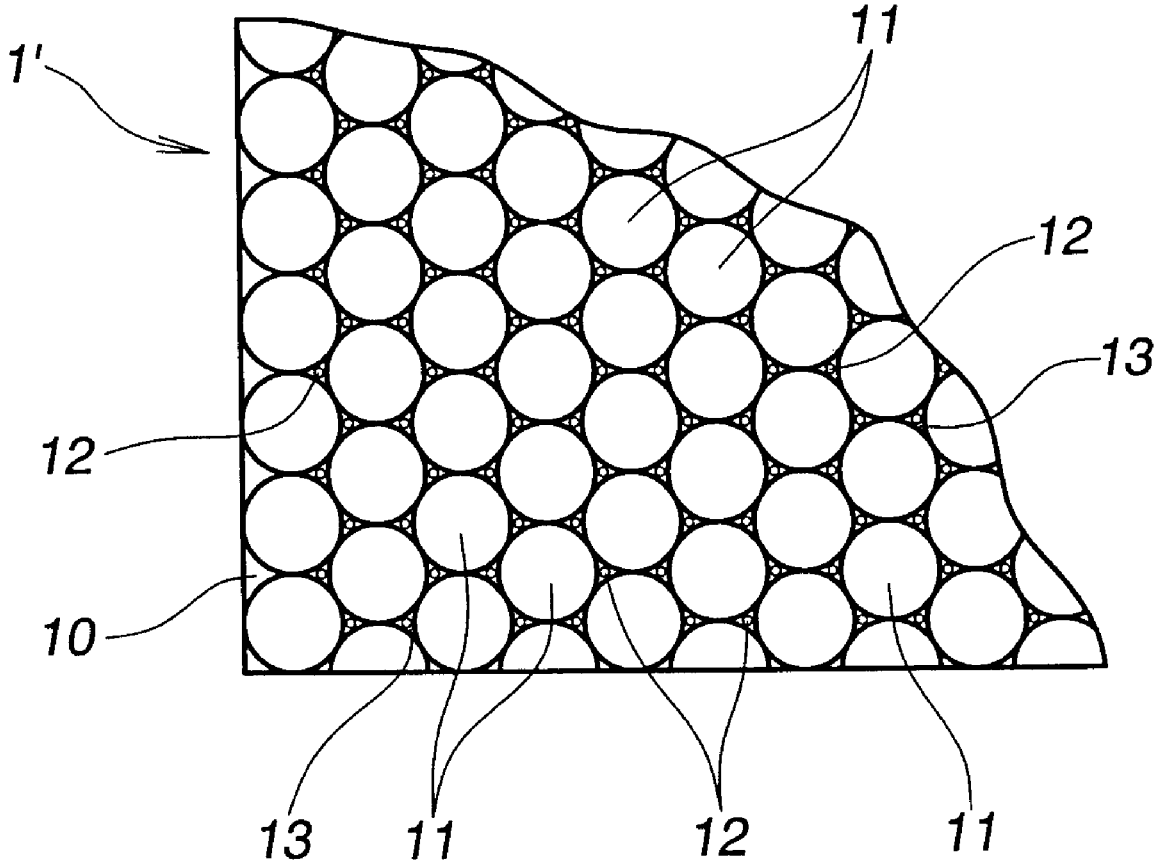
FIG. 6 is a view similar to FIG. 3, but showing a modified form of the shock-absorbing elastic sheet.

FIG. 6 shows a modified form of the shock-absorbing elastic sheet according to the present invention. The modified shock-absorbing elastic sheet 1' differs from the elastic sheet 1 of FIG. 3 in that a single recessed portion or valley 13 is defined between every adjacent three semispherical protrusions 11. Since the semispherical protrusions 11 are arranged at a higher density in the modified elastic sheet 1' than in the elastic sheet 1, the modified shock-absorbing elastic sheet 1' can offer a rigid cushion feel as compared to the elastic sheet 1.

Figure 7:
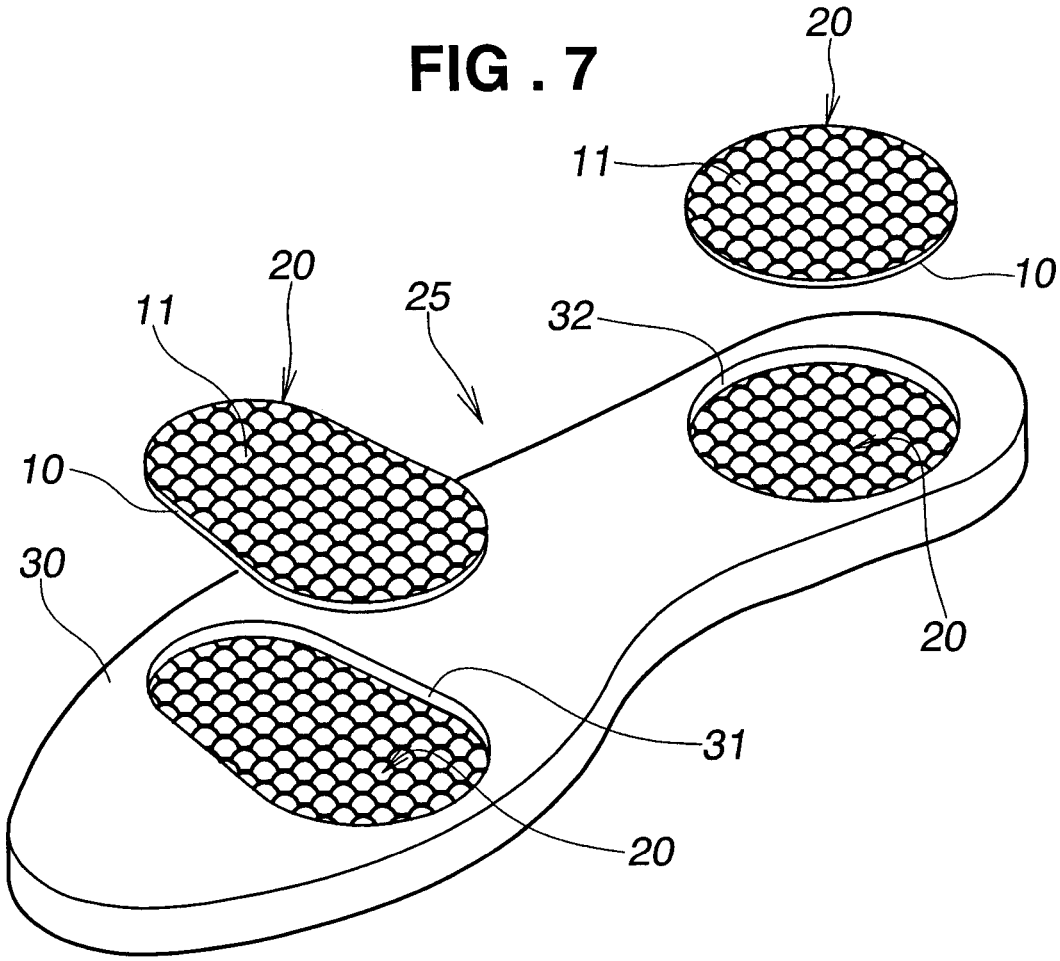
FIG. 7 is a perspective view of a sole insert looking from a rear side thereof, showing cushion pads of different configurations produced from the shock-absorbing elastic sheet of FIG. 1 are fitted in a stacked fashion in recessed portions of the sole insert.

FIG. 7 shows in perspective view a sole insert 25 incorporating therein cushion pads 20 produced from the elastic sheet 1 according to the present invention. The cushion pads 20 shown in FIG. 7 have two different configurations, one being oblong and the other being circular. These cushion pads 20 are produced by cutting the elastic sheet 1 (FIG. 1) into a desired configuration. The sole insert 25 includes a body 30 formed from urethane and has a configuration suitable for removable insertion in a shoe. The sole insert body 30 has a front recess 31 and a rear recess 32 formed in a ball portion and a heel portion, respectively, of the sole insert body 30 that are corresponding in position to a ball (between a toe and an arch) and a heel of a wearer's foot. The front recess 31 is oblong-shaped and receptive of the oblong cushion pads 20, and the rear recess 32 is circular-shaped and receptive of the circular cushion pads 20.

Figure 8:
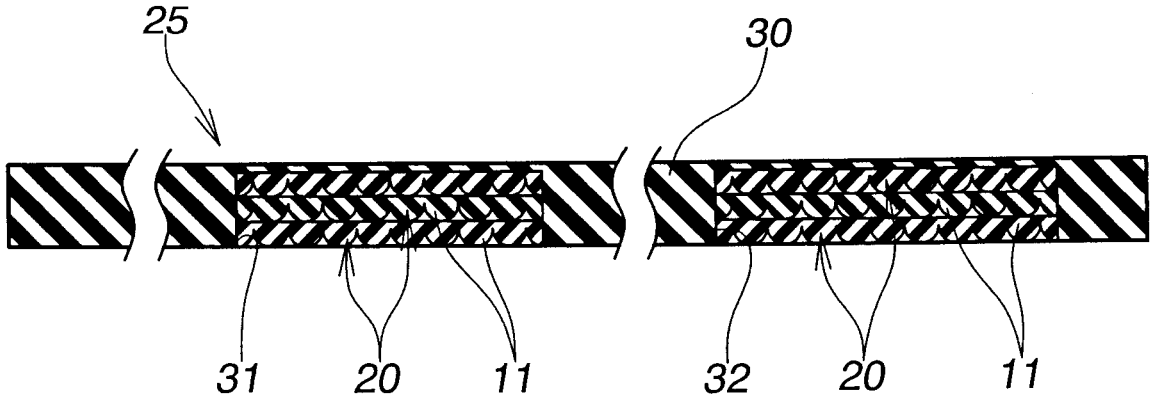
FIG. 8 is a longitudinal cross-sectional view of the sole insert before being fitted in a shoe.

As shown in FIG. 8, each of the front and rear recesses 31, 32 has three cushion pads 20 disposed therein in a stacked fashion with the semispherical protrusions 11 directed toward an open end of each recess 31, 32. Though not shown, the cushion pads 20 may be fitted in each recess 31, 32 with the semispherical protrusions 11 directed toward a bottom of the recess 31, 32. Furthermore, the number of the cushion pad 20 to be placed in each recess 31, 32 is optional and determined mostly depending on design and functional requirements of a shoe in which the shoe insert 25 is to be placed. The depth of the recesses 31, 32 is determined in accordance with the number of the cushion pad 20 received in each recess 31, 32.

Figure 9:
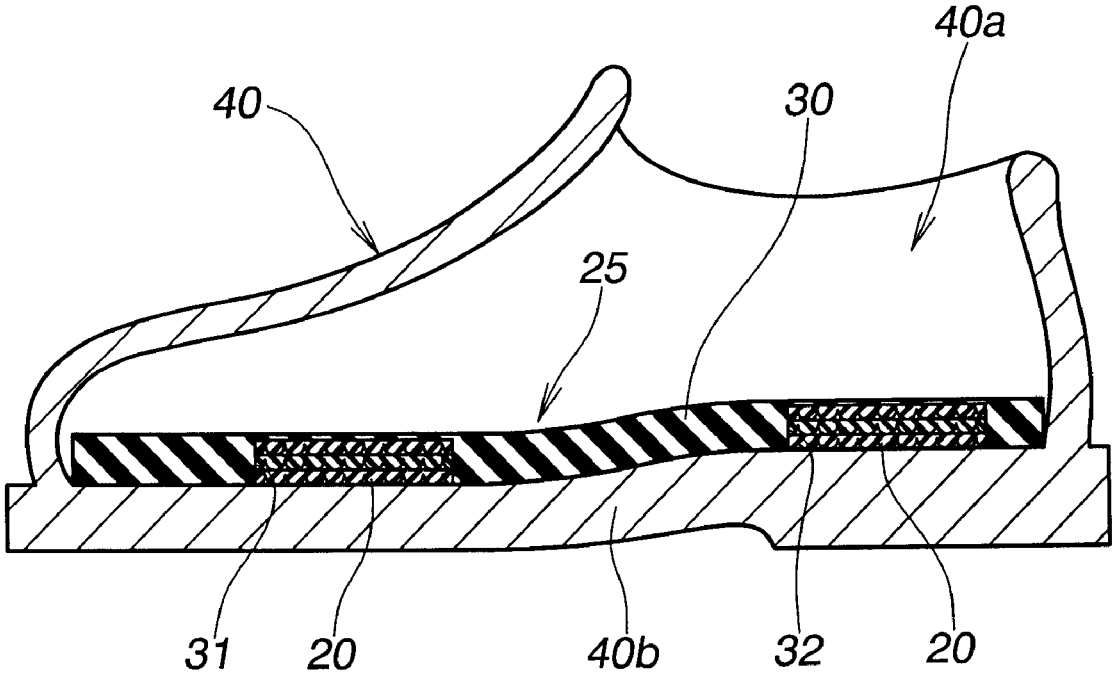
FIG. 9 is a cross-sectional view of a shoe with the sole insert fitted therein.

The shoe insert 25 shown in FIG. 8 is inserted in a shoe, as shown in FIG. 9. In FIG. 9, the shoe comprises a business shoe and has a shoe body 40 having an internal space 40*a* for receiving therein a wearer's foot (not shown) and a fixed sole member 40*b* defining a part of the internal space 40*a*. The shoe insert body 30 is removably inserted in the internal space 40*a* of the shoe body 40 and laid over the fixed sole member 40*b* of the shoe body 40 in such a manner that the open end of each recess 31, 32 is closed by the fixed sole member 40*b* of the shoe body 40 with the three cushion pads 20 received in stacked condition within each recess 31, 32. The semispherical protrusions 11 (FIG. 8) of the stacked cushion pads 20 are oriented toward the fixed sole member 40*b* of the shoe body 40.

With this arrangement, since at least one cushion pad 20 (three in the illustrated embodiment) is provided at the ball and heel portions of the sole insert body 30 where the weight of a shoe wearer is applied intensively, the cushion pads 20 can effectively absorb shocks during walking while performing a breathing action to promote circulation of air inside the shoe. Stated more specifically, each time the shoe wearer lands on the foot during walking, the cushion pads 20 undergo elastic compressive deformation to thereby absorb a landing shock. The compressed cushion pads 20 are then allowed to restore their original shape or configuration. During repeated compression and recovery of the shape of the cushion pads 20, air is expelled from and taken into each recessed portion 31, 32 through the breathing holes 12 of the cushion pads 20. With this breathing action, air inside the shoe is circulated, thereby preventing the shoe inside from becoming hot and humid. Furthermore, since the semispherical protrusions 11 (FIG. 7) and the sheet-like base portion 10 of each cushion pad 20 are formed integrally with each other, the semispherical protrusions 11 cannot flow or move into a different position even when they are compressed during use of the shoe. Thus, the shoe can provide an extremely high level of foot comfort to the wearer.

Although in the embodiment shown in FIGS. 7-9, three cushion pads 20 are disposed in a layered or stacked condition in each recessed portion 31, 32 of the sole insert body 30, the aforementioned shock-absorbing and breathing functions can be attained even when only a single cushion pad 20 is used for each recessed portion 31, 32.

Figure 10:
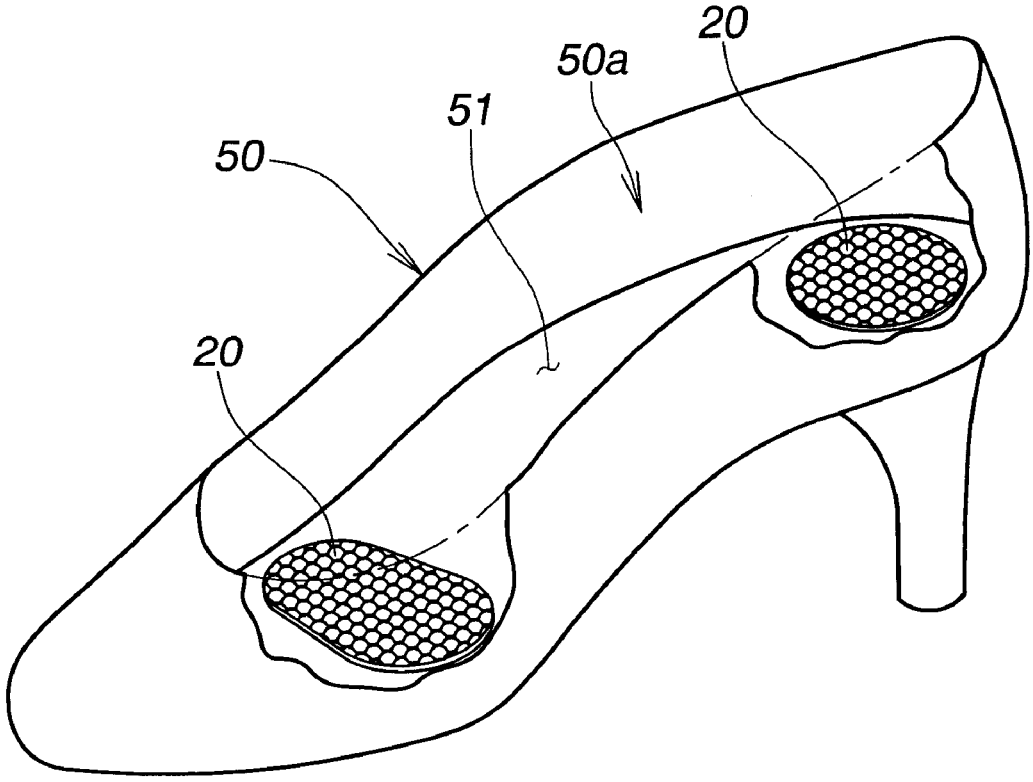
FIG. 10 is a perspective view with parts cutaway for clarity of a women's shoe having cushion pads attached directly to an inner sole member of the shoe.

FIG. 10 shows a women's shoe or pump having cushion pads according to the invention. The shoe has a shoe body 50 having an internal space 50*a* for receiving therein a wearer's foot (not shown) and a fixed inner sole member 51 defining a part of the internal space 50 of the shoe. The shoe also includes two cushion pads 20 attached by bonding or sewing to the fixed inner sole member 51. One of the cushion pads 20 has an oblong shape and is provided at a ball portion of the inner sole member 51 which is corresponding in position to a ball (between a toe and an arch) of a wearer's foot (not shown), and the other cushion pad 20 has a circular shape and is provided at a heel portion of the inner sole member 51 which is corresponding in position to a heel of the wearer's foot. Though not shown, the shoe has an insole cover sheet overlying the inner sole member 51 and the cushion pads 20. In this embodiment, the cushion pads 20 are arranged to form a single cushion layer so as not to deteriorate the fashionability or aesthetic appearance of the women's shoe. The shoe having a single layer of cushion pads 20 is as attractive in appearance as a conventional shoe not equipped with cushion pads. Furthermore, by virtue of the cushion pads 20, the shoe possesses a shock-absorbing function and a breathing function and hence can offer an improved degree of foot comfort to the wearer. The cushion pads 20 can be used with mules and sandals.

As thus far described, the shock-absorbing elastic sheet 1 of the invention can be produced by molding and hence is inexpensive to manufacture. Furthermore, by virtue of semispherical protrusions 11 formed integrally with and projecting from one surface of a flat base portion 10, the elastic sheet 1 possesses a shock-absorbing function, which can be achieved when the elastic sheet 1 is subjected to a force or pressure acting at an angle to the general plane of the flat base portion 10. Additionally, owing to the breathing holes 12 formed in the flat base portion 10, the elastic sheet 1 is able to perform a breathing function when it is compressed and then allowed to restore its original shape. The cushion pads 20 are produced by cutting the elastic sheet 1 into a desired configuration and hence automatically possesses the shock-absorbing function and the breathing function. The cushion pads 20, when used in a sole insert removably fitted in a shoe or attached to a fixed sole member of a shoe, enable the shoe to achieve the shock-absorbing function and the breathing function during use of the shoe without deteriorating the aesthetic appearance of the shoe. The shoe equipped with the cushion pads 20 can offer a high level of foot comfort to a shoe wearer.

Obviously, various minor changes and modifications of the present invention are possible in the light of the above teaching. It is therefore to be understood that within the scope of the appended claims the invention may be practiced otherwise than as specifically described.

What is claimed is:

1. A shock-absorbing elastic sheet, comprising:

a single sheet of elastic material having a flat sheet-like base portion and a large number of semispherical protrusions integral with and projecting from one surface of the sheet-like base portion, the semispherical protrusions being arranged in direct contact with one another such that every adjacent three or more of the semispherical protrusions jointly define a valley therebetween, the sheet-like base portion having a large number of breathing holes formed therein, each of the breathing holes being located at a position corresponding to the position of one of the respective valleys.

2. The shock-absorbing elastic sheet according to claim 1, wherein the elastic material comprises silicone rubber.

3. The shock-absorbing elastic sheet according to claim 1, wherein the sheet-like base portion has a thickness of 0.5 to 1.0 mm, the semispherical protrusions have a diameter of 5.0 mm and a height of 1.5 to 2.5 mm, and the breathing holes have an inside diameter of 1.0 mm.

4. A cushion pad of a desired configuration cut out from the shock-absorbing elastic sheet of claim 1.

5. The cushion pad of claim 4, wherein the elastic material comprises silicone rubber.

6. The cushion pad of claim 4, wherein the sheet-like base portion has a thickness of 0.5 to 1.0 mm, the semispherical protrusions have a diameter of 5.0 mm and a height of 1.5 to 2.5 mm, and the breathing holes have an inside diameter of 1.0 mm.

7. A cushion pad comprising:

a sheet-like base portion; and a number of semispherical protrusions integral with and projecting from one surface of the sheet-like base portion, the semispherical protrusions being arranged in direct contact with one another such that every adjacent three or more of the semispherical protrusions jointly define a valley therebetween, wherein the sheet-like base portion and the semispherical protrusions are integrally formed from an elastic material, and the sheet-like base portion has a number of breathing holes formed therein, each of the breathing holes being located at a position corresponding to the position of one of the respective valleys.

8. The cushion pad according to claim 7, wherein the elastic material comprises silicone rubber.

9. The cushion pad according to claim 7, wherein the sheet-like base portion has a thickness of 0.5 to 1.0 mm, the semispherical protrusions have a diameter of 5.0 mm and a height of 1.5 to 2.5 mm, and the breathing holes have an inside diameter of 1.0 mm.

10. A sole insert for a shoe, comprising:

a sole insert body for removable insertion in the shoe and having at least one recess formed therein; and at least one cushion pad formed from an elastic material and fitted in the at least one recess of the sole insert body, the cushion pad comprising:

a sheet-like base portion; and a number of semispherical protrusions integral with and projecting from one surface of the sheet-like base portion, the semispherical protrusions being arranged in direct contact with one another such that every adjacent three or more of the semispherical protrusions jointly define a valley therebetween, wherein the sheet-like base portion has a number of breathing holes formed therein, each of the breathing holes being located at a position corresponding to the position of one of the respective valleys.

11. The sole insert according to claim 10, wherein the sole insert body has a ball portion and a heel portion respectively corresponding in position to a ball and a heel of a shoe wearer's foot, and the at least one recess comprises two recesses located at the ball portion and the heel portion of the sole insert body.

12. The sole insert according to claim 10, wherein the elastic material of the at least one cushion pad comprises silicone rubber.

13. The sole insert according to claim 12, wherein the sole insert body is formed from urethane.

14. The sole insert according to claim 10, wherein the sheet-like base portion has a thickness of 0.5 to 1.0 mm, the semispherical protrusions have a diameter of 5.0 mm and a height of 1.5 to 2.5 mm, and the breathing holes have an inside diameter of 1.0 mm.

15. The sole insert according to claim 10, wherein the at least one cushion pad comprises a plurality of cushion pads disposed in a stacked fashion within the at least one recess.

16. The sole insert according to claim 15, wherein the cushion pads are disposed with the protrusions directed toward an open end of the at least one recess.

17. A shoe comprising:

a shoe body having an internal space for receiving herein a wearer's foot and a fixed sole member defining part of the internal space; and a sole insert having a body removably inserted in the internal space of the shoe body and laid over the fixed sole member of the shoe body, the sole inert body having at least one recess formed therein, the sole insert further having at least one cushion pad formed from an elastic material and fitted in the at least one recess of the sole insert body, the cushion pad comprising:

a sheet-like base portion; and a number of semispherical protrusions integral with and projecting from one surface of the sheet-like base portion, the semispherical protrusions being arranged in direct contact with one another such that every adjacent three or more of the semispherical protrusions jointly define a valley therebetween, wherein the sheet-like base portion has a number of breathing holes formed therein, each of the breathing holes being located at a position corresponding to the position of one of the respective valleys.

18. The shoe according to claim 17, wherein the at least one recess in the sole insert body has an open end closed by the fixed sole member of the shoe body.

19. The shoe according to claim 17, wherein the sole insert body has a ball portion and a heel portion respectively corresponding in position to a ball and a heel of the wearer's foot, and the at least one recess comprises two recesses located at the ball portion and the heel portion of the sole insert body.

20. The shoe according to claim 17, wherein the cushion pad is formed from silicone rubber.

21. The shoe according to claim 20, wherein the sole insert body is formed from urethane.

22. The shoe according to claim 17, wherein the sheet-like base portion has a thickness of 0.5 to 1.0 mm, the semispherical protrusions have a diameter of 5.0 mm and a height of 1.5 to 2.5 mm, and the breathing holes have an inside diameter of 1.0 mm.

23. The shoe according to claim 17, wherein the at least one cushion pad comprises a plurality of cushion pads disposed in a stacked fashion within the at least one recess.

24. The shoe according to claim 23, wherein the cushion pads are disposed with the protrusions directed toward an open end of the at least one recess.

25. A shoe comprising:

a shoe body having a fixed inner sole member for supporting thereon a wearer's foot; and a cushion pad formed from an elastic material and attached to the inner sole member of the shoe body, the cushion pad comprising:

a sheet-like base portion; and a number of semispherical protrusions integral with and projecting from one surface of the sheet-like base portion, the semispherical protrusions being arranged in direct contact with one another such that every adjacent three or more of the semispherical protrusions jointly define a valley therebetween, wherein the sheet-like base portion has a number of breathing holes formed therein, each of the breathing holes being located at a position corresponding to the position of one of the respective valleys.

* * * * *